United States Patent [19]

Gailey et al.

[11] 4,356,216

[45] Oct. 26, 1982

[54] PROCESS FOR PRODUCING STRIPED SURFACE COATINGS

[75] Inventors: J. Lynn Gailey, Newton Falls; Carl A. Wollam, Cortland, both of Ohio

[73] Assignee: Alcan Aluminum Corporation, Cleveland, Ohio

[21] Appl. No.: 226,705

[22] Filed: Jan. 21, 1981

[51] Int. Cl.[3] ..... B05D 5/00

[52] U.S. Cl. ..... 427/286; 118/411; 427/262; 427/280; 427/294; 427/295

[58] Field of Search ..... 427/286, 280, 356, 287, 427/357, 294, 358, 295, 262, 267; 118/411, 412, 410, 415

[56] References Cited

U.S. PATENT DOCUMENTS

| | | | |
|---|---|---|---|
| 896,504 | 8/1908 | Adams | 118/412 |
| 1,830,662 | 11/1931 | Kail | 427/286 |
| 2,526,991 | 10/1950 | Biddle | 118/413 |
| 2,695,005 | 11/1954 | Lewin et al. | 118/413 |
| 2,916,012 | 12/1959 | Hergenrother | 118/315 |
| 3,106,480 | 10/1963 | Baker | 427/286 |
| 3,203,393 | 8/1965 | Colwill | 118/412 |
| 3,886,898 | 6/1975 | Colegrove et al. | 118/411 |

FOREIGN PATENT DOCUMENTS

| | | | |
|---|---|---|---|
| 283973 | 7/1965 | Australia | 427/286 |

*Primary Examiner*—Sadie L. Childs

*Attorney, Agent, or Firm*—Cooper, Dunham, Clark, Griffin & Moran

[57] ABSTRACT

In the coating of a major surface of a strip article, wherein the strip surface is advanced longitudinally past a dam and, immediately beyond the dam, past an extended wall spaced from the strip surface by a gap equal to a desired wet coating thickness, a first liquid coating material is applied to the strip surface ahead of the dam and a second liquid coating material is delivered under pressure to the gap beyond the dam through one or more apertures in the wall to produce a stripe or stripes of the second coating material. The apertures can be provided in a rotatable disk, constituting a portion of the wall; rotary movement of the disk angularly displaces the apertures so as to vary the location and spacing of the produced stripes, for example in a manner simulating the appearance of natural wood grain.

13 Claims, 13 Drawing Figures

Fig. 1.
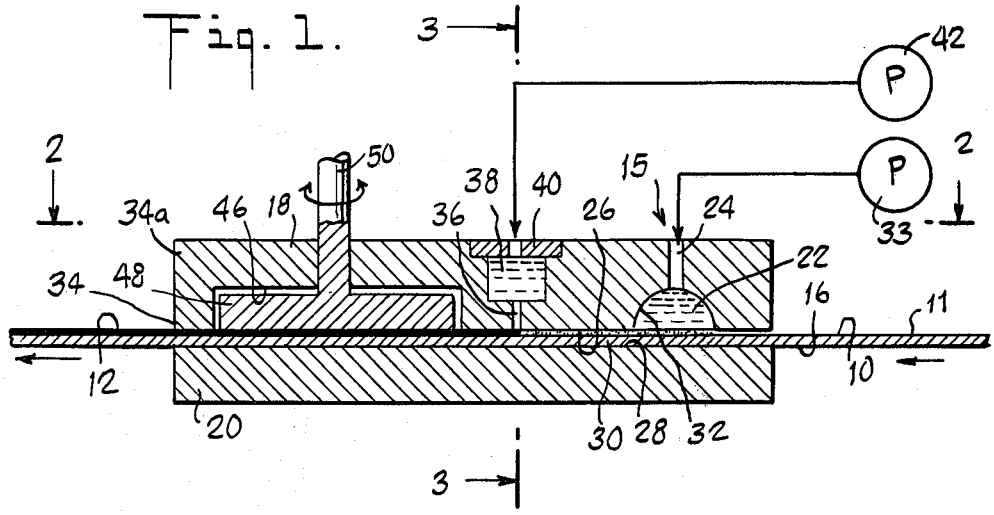
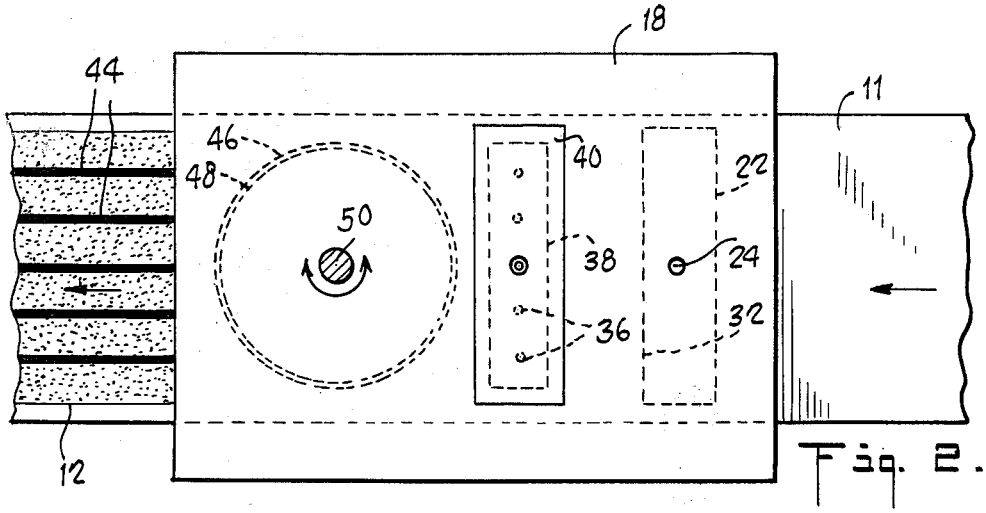
Fig. 2.
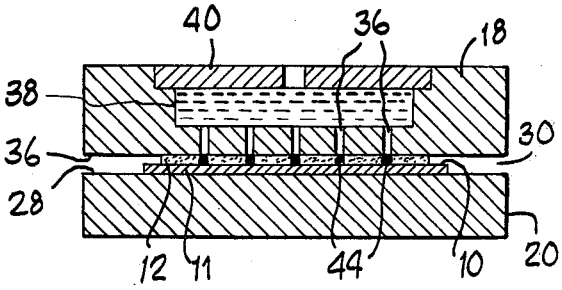
Fig. 3.

Fig. 4.
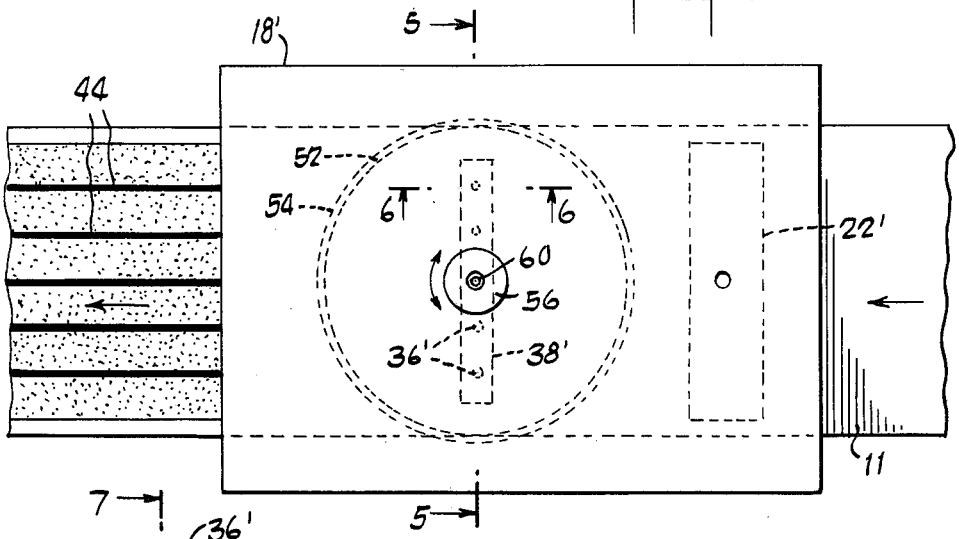
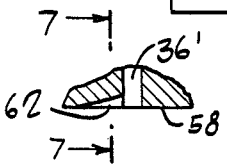
Fig. 6.
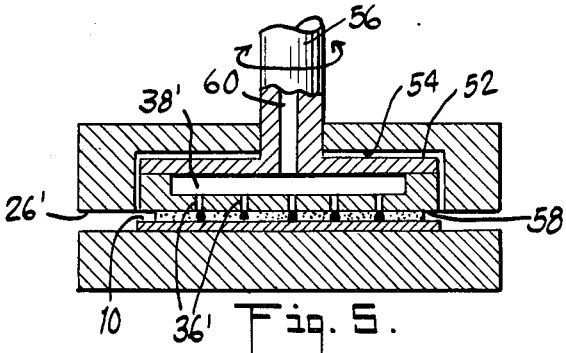
Fig. 5.
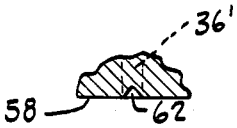
Fig. 7.
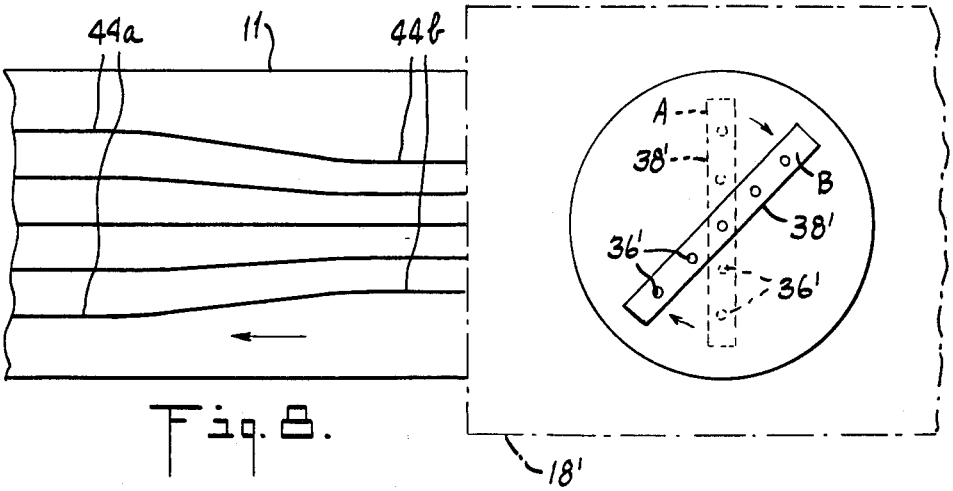
Fig. 8.

PROCESS FOR PRODUCING STRIPED SURFACE COATINGS

BACKGROUND OF THE INVENTION

This invention relates to procedures and apparatus for producing striped or striated coatings of paint or the like on extended solid surfaces. In an important particular sense, it is directed to the production of longitudinally striped surface coatings on elongated strip articles, and especially to the provision of coatings wherein the lines or stripes vary in spacing and lateral position along the length of the coated article, for example to create a pattern simulating the appearance of natural wood grain.

By way of specific illustration, detailed reference will be made herein to the coating of sheet material (e.g. aluminum) in greatly elongated strip form, as used for making siding panels for cladding exterior building walls, it being understood, however, that the invention in its broader aspects embraces the coating of other types of articles and surface as well.

In the production of siding panels from metal strip, at least one major surface of the strip is first coated with paint, and the strip is then formed and cut into individual panels, which are commonly shaped to resemble wooden siding panels. It is often desired to impart to the exposed panel surfaces a simulated wood grain appearance. Conventionally, this has been accomplished by applying, over a pre-established paint coating on a metal strip surface, a pattern of lines or striations of a second color. The grain pattern thus produced, however, is preferentially vulnerable to wear and weathering since it is an overlay, and it has other disadvantages as well; for instance, when the pattern is applied from a roll having a paint-bearing wood-grain design of elevated or recessed portions formed on its surface, the same pattern repeats at regular, relatively short intervals equal to the circumference of the roll, unlike the appearance of actual wood grain which varies randomly and nonrepetitively.

Applicants' copending United States patent application Ser. No. 6,226,699, filed concurrently herewith, entitled "Coating Process and Apparatus" and assigned to the same assignee as the present application, describes certain strip-coating processes and apparatus of the general type employing a dam extending transversely across a major surface of a longitudinally advancing strip, with deposit of wet coating material on that strip surface immediately ahead of the dam, wherein, immediately beyond the dam, the strip is advanced longitudinally past a smooth and rigid wall (facing the coated strip surface) of extended length in the direction of strip advance, and at least as wide as the coated strip surface; during its advance past the wall, the strip is uniformly restrained against movement of its coated surface away from the wall by more than a predetermined distance equal to the desired coating thickness, so that the wall and strip mutually define a gap entirely filled with the wet coating layer. As explained in the aforementioned copending application, these features afford advantageously high uniformity of coating thickness even on strip which may be wavy-edged, oil-canned, or otherwise deformed. Moreover, the described arrangement provides better metering of the coating material than conventional techniques using rolls or doctor blades; substantially all the supplied coating material is usefully consumed to provide the desired coating, with virtually no loss due to spillage over the sides; and entrapment of air in the coating is avoided.

It would be desirable to provide, in conjunction with such coating techniques, means and methods for producing striped patterns that overcome the difficulties heretofore encountered in attempting, for example, to achieve a wood-grain appearance.

SUMMARY OF THE INVENTION

The present invention broadly contemplates the provision, in a process of the type described in the aforementioned copending application (wherein a strip article, coated with a layer of a first liquid coating material, is advanced past an extended wall so as to define therewith a gap filled by the wet coating layer), of the improvement which comprises delivering at least a second liquid coating material to the gap, through at least one aperture in the wall, under pressure sufficient to displace locally the first liquid coating material in the wet coating layer, thereby to establish a stripe of the second liquid coating material in the coating layer. To achieve a multistripe pattern, the second liquid coating material is delivered under pressure to the gap through a plurality of apertures spaced apart, in the wall, transversely of the direction of advance of the strip article. As will be understood, the first and second coating materials are visually distinguishable, e.g. different from each other in pigmentation; if some degree of blending of the two colors along the stripe or stripes is desired, a portion of the wall beyond the aperture or apertures can be made movable (for example, provided as a rotatable disk), and moved as the strip advances.

As an important particular feature of the invention, affording the capability of producing wood-grain-simulating patterns and other complex designs, the present process advantageously further includes the step of moving the apertures transversely of the strip article while the strip is advancing and while the second liquid coating material is being delivered through the apertures, to vary progressively, along the length of the article, the positions of the stripes relative to the sides of the article. Very effectively, this movement of the apertures is performed by angularly displacing them about an axis perpendicular to the coated strip surface, so as to vary the spacing between the stripes as well as the positions of the stripes. With use of a sufficient number of apertures, satisfactory simulation of wood grain can thereby be achieved.

It is found that in the patterned coatings produced by the present invention, the second-color stripes do not merely overlie the first or ground color of the coating but extend through the thickness of the coating, owing to the fact that the delivered second-color coating material displaces the still liquid first-color coating material; hence the second-color pattern of stripes is not vulnerable to preferential wear and early disappearance upon weathering. In addition, nonrepeating and apparently random patterns of any desired length can be produced by appropriately moving the apertures, yet a particular pattern is substantially reproducible by repetition of the same sequence of aperture movements.

The invention further contemplates the provision of apparatus for performing the present process. In preferred embodiments, the apparatus includes a rotatably mounted disk having a surface constituting a portion of a planar wall (past which the strip article being coated advances), with a plurality of coating material delivery apertures formed in the disk and means for supplying liquid coating material thereto. Rotation of the disk, in these embodiments, angularly displaces the apertures for varying the location and spacing of the produced stripes.

The coating process of the invention is preferably used to apply a coating directly onto the surface of a strip article (e.g. metal strip of indeterminate length to be formed into siding panels) which is ultimately to bear the coating. Alternatively, the coating can be applied onto a surface of an endless transfer belt, roll or the like from which the coating is subsequently transferred, while still wet, onto the surface which is ultimately to be coated. The term "strip article" as used herein accordingly in its broadest sense also embraces an endless transfer belt, roll, or other structure providing a moving transfer surface on which a coating layer is initially deposited. It is to be understood that the term "stripes" is used herein to include lines, striations, and bands, and other such forms without limitation as to any particular width thereof. Also, the term "liquid coating material" is used herein to embrace materials such as paints containing, in a liquid vehicle, a suspension of finely divided solid pigment.

Further features and advantages of the invention will be apparent from the detailed description hereinbelow set forth, together with the accompanying drawings.

BRIEF DESCRIPTION OF THE DRAWINGS

FIG. 1 is a schematic side elevational sectional view of one illustrative embodiment of the apparatus of the invention;

FIG. 2 is a top plan view taken as along the line 2—2 of FIG. 1;

FIG. 3 is a transverse elevational sectional view taken as along the line 3—3 of FIG. 1;

FIG. 4 is a schematic top plan view, similar to FIG. 2, of another embodiment of the invention;

FIG. 5 is a transverse elevational sectional view taken along the line 5—5 of FIG. 4;

FIG. 6 is an enlarged fragmentary detail sectional view of a portion of the disk of the apparatus of FIG. 4, taken as along the line 6—6 of FIG. 4;

FIG. 7 is a similarly enlarged fragmentary detail sectional view taken as along the line 7—7 of FIG. 6;

FIG. 8 is a diagrammatic plan view illustrating the effect, on the produced coating patterns, of angular displacement of the disk in the apparatus of FIG. 4;

DETAILED DESCRIPTION

Figure 10:
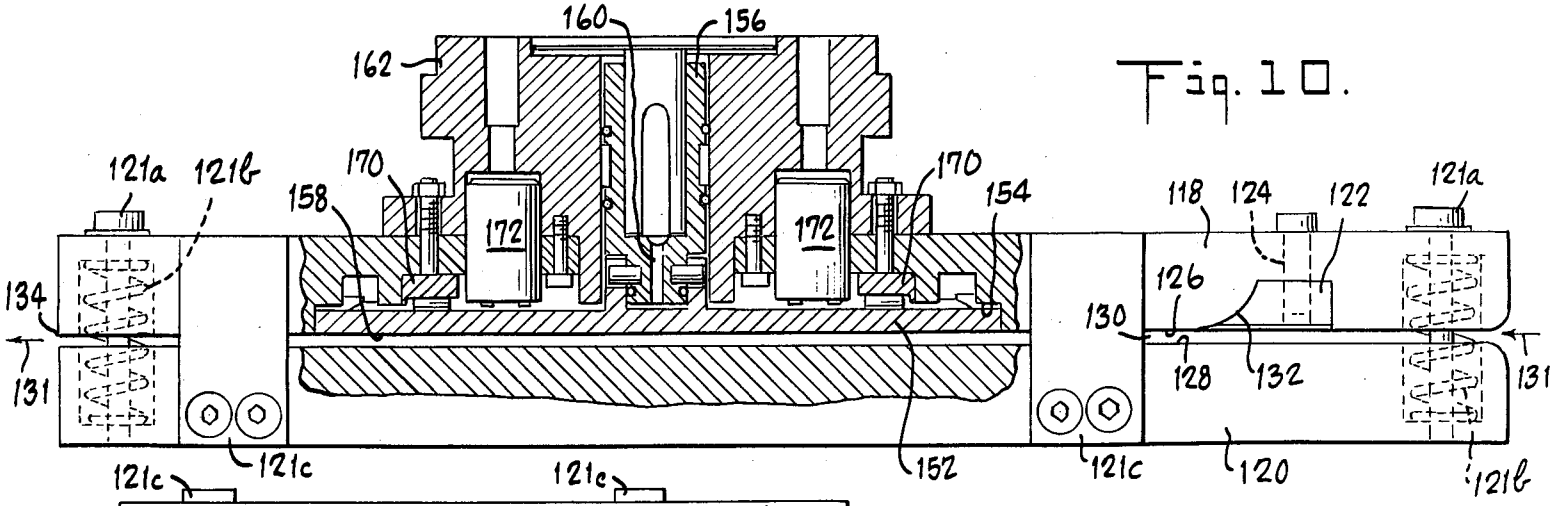
FIG. 10 is an enlarged side elevational view, partly in section, taken along the line 10—10 of FIG. 9.

Referring first to FIGS. 1—3, the invention will be described as embodied in a process for continuously coating one major surface 10 of a metal (e.g. aluminum) strip 11 of indeterminate length with a continuous layer 12 of liquid coating material, such as paint, extending over the entire strip surface except for narrow marginal portions along the longitudinal edges of the strip. For such coating, the strip is continuously advanced longitudinally (as from a supply coil, not shown) along a defined path past a locality 15 at which the wet paint is applied to the surface 10, and thence to a heating zone (not shown) where the coating is cured or dried. The other major surface 16 of the strip can be coated before or after the described coating of the surface 10, or left uncoated. Once the coating of the strip is complete, the strip can be formed and cut into a desired product such as siding panels.

The apparatus with which the process of the invention is performed is shown (by way of example) in FIGS. 1–3 as comprising a pair of rigid flat plates 18 and 20 fixedly mounted, in superposed facing uniformly spaced relation to each other, at a portion of the path of advance of the strip 11 at which the strip major surfaces are substantially horizontal with surface 10 facing upwardly, the plates 18 and 20 being respectively disposed above and below the strip so that the path of strip advance passes between them. The upper plate 18 has an elongated reservoir trench 22 dimensioned to extend across the full width of the portion of the strip surface 10 to be coated; the tranch is closed at both ends and opens downwardly toward the strip upper surface 10, for confining a body or pool of a first liquid coating material such as paint in contact with the strip surface 10. Paint is supplied to the trench 22 through a passage 24 opening downwardly through the upper surface of the plate 18 into the trench. Immediately beyond the trench 22, the plate has a smooth, downwardly facing horizontal planar surface 26 that extends across the full width of the strip and also extends downstream from the trench for a substantial distance in the direction strip advance; the lower plate 20 has a smooth upwardly-facing horizontal planar surface 28 also extending across the full width of the strip and longitudinally of the strip over at least the full extent of the upper plate surface 26.

The surfaces 26 and 28 respectively constitute the upper and lower walls of a throat 30 of extended length in the direction of strip advance. Since these surfaces 26 and 28 lie in parallel horizontal planes (and are thus spaced apart by a uniform distance at all points), the throat 30 is of uniform height. The spacing between the two plate surfaces (i.e. the height of throat 30) is selected to be equal to the thickness of the strip 11 plus a desired wet thickness of coating layer on the strip surface 10, and is maintained at a fixed value during any given coating operation, although the spacing between the plates may be adjustable. The internal surface 32 of the upper plate 18 which defines the downstream side of the reservoir trench 22 constitutes a dam, extending transversely across the strip surface 10 at the inlet end of the throat 30 and retaining the coating material on its upstream side in the reservoir.

In the practice of the present process, the locality 15 at which the coating material is applied to the strip surface 10 is the location of the reservoir trench. The trench is maintained continuously entirely filled with the first liquid coating material, which is supplied to the trench under pressure by means shown as a pump 33, although the coating material could be supplied by gravity feed under hydrostatic pressure. As the strip advances past the trench, the surface 10 is progressively brought into contact with the pool of liquid coating material therein. The advancing movement of the strip draws coating material from the trench on the strip surface 10 into the throat 30, i.e. into the space between the strip surface 10 and the facing throat wall 26, as a continuous wet coating layer filling that space and forcing the strip against the other wall 28 notwithstanding any undulating or other deformation initially present in the strip. In this way, as the strip advances through the throat 30, the distance from the strip surface 10 to the wall 26 becomes uniform at all points and, since the space or gap defined between the surface 10 and wall 26 is filled with liquid coating material, a uniform wet thickness of coating layer over the entire surface 10 is achieved, even though as the strip emerges from the throat 30 at the outlet or downstream end thereof, any deformation initially present in the strip reappears. Thus, with progressive supply of wet coating material to the trench 22 at a rate sufficient to maintain the trench completely filled, the strip surface 10 is uniformly and continuously coated.

It will be understood that in this embodiment, the surface 26 of the plate 18 constitutes the wall facing the coating strip surface, and the plate 20 constitutes a means for uniformly restraining the strip against movement more than a predetermined distance away from the wall. The downstream end of the latter wall is a sharp edge 34 formed by the intersection of surface 26 with a planar plate end surface 34*a*, shown as perpendicular to the direction of strip advance; more generally, the angle between the plane of surface 34*a* and the direction of strip advance is at least sufficient to avoid cavitation effects that could cause irregularities in the coating emerging from the throat 30.

Preferably, in at least many instances, in operation the reservoir trench 22 is kept completely filled with paint, under pressure. In this way, there can be no entrapment of air in the produced coating. It is also preferred, and at least considered advantageous for atainment of satisfactory coatings, that the strip surface to be coated be primed, i.e. with a primer coat applied prior to performance of the coating operation of the present invention.

The foregoing features, as thus far described, are generally shown and set forth in applicants' aforementioned copending application.

In accordance with the present invention, in the embodiment of FIGS. 1–3, a plurality of small apertures 36 (five being shown) are provided in the upper plate 18, opening downwardly through the wall 26 into the gap defined between that wall and the coated strip surface 10, beyond the dam 32, at locations spaced across the width of the surface 10. These apertures all communicate with a manifold trough 38, illustrated as formed in the plate 18 and closed by a cover 40. In the practice of the present process, the trough 38 is maintained entirely filled with a second liquid coating material (e.g. differing in color from the aforementioned first liquid coating material) supplied under pressure from a source represented as a pump 42, although, again, the second liquid coating material could be supplied by gravity feed under hydrostatic pressure.

Specifically, the second liquid coating material is delivered to the gap between the wall 26 and the strip surface 10 (i.e. at five spaced locations, via the apertures 36) under pressure sufficient to locally displace the first liquid coating material of the wet coating layer which already fills the gap, thereby to establish in the coating layer a longitudinal stripe 44 at the location of each of the apertures. This displacement occurs because of the selected supply pressure of the second liquid coating material and because the already-applied layer of the first liquid coating material is still wet, having been maintained fully enclosed by the plate assembly at and downstream of the dam 32. It is believed that the effect of this displacement acts in an upstream direction, i.e. toward the reservoir trench 22, rather than laterally, as there is substantially no observed lateral displacement or leakage of coating material; in any event, owing to the displacement of the first liquid coating material by the second at the locations of the apertures 36, the resultant stripes 44 extend substantially entirely through the thickness of the produced coating rather than merely overlying the layer of the first coating material. Consequently, the stripes do not wear preferentially or disappear prematurely upon weathering.

The stripes 44 of the second liquid coating material are narrow and sharply defined, extending parallel to each other from the five apertures 36, and exhibit very little if any blending with the first liquid coating material. Some degree of blending along the stripes may be effected, if desired, by providing a movable portion of the wall 26 downstream of the apertures 36 and moving that wall portion, in the plane of the wall, transversely of the direction of strip advance. To this end, in the apparatus of FIGS. 1–3, the upper plate 18 has a circular recess 46 opening downwardly through the surface or wall 26 downstream of the apertures 36; within this recess is disposed a disk 48, very slightly smaller than the recess in diameter, having a downwardly facing surface coplanar with and effectively constituting a part of the wall 26. The disk is mounted (by means of a shaft 50 projecting upwardly through a bore in the plate 18) for angular displacement about an axis perpendicular to the plane of wall 26. The diameter and location of the disk are such that the disk surface is traversed by, and thus in contact with, the five stripes 44 emerging from the apertures 36. Angular displacement of the disk about the aforementioned axis moves its downwardly facing surface in the plane of the wall 26 with a component of motion transverse to the direction of strip advance; the resultant drag on the disk-engaging surface of the wet coating layer causes some blending of the two coating materials along the stripes, as may be desired for particular pattern effects.

The embodiment of FIGS. 4–8 differs from that of FIGS. 1–3 in that the apertures for delivering the second liquid coating material to the gap between the strip being coated and the facing wall are angularly displaceable about an axis perpendicular to the plane of the coated strip surface 10. Thus, a disk 52 is disposed in a circular recess 54 which is formed in the upper plate 18' of the apparatus of FIGS. 4–8 and which opens downwardly through the wall 26' downstream of the trench 22' in the path of strip advance, the disk being only slightly smaller in diameter than the recess. The disk 52, mounted (by means of a shaft 56 that projects upwardly through a bore in plate 18') for rotation about an axis perpendicular to wall 26', has a lower surface 58 coplanar with and effectively constituting part of the wall 26'. Five coating material delivery apertures 36', formed in the disk 52, open through the surface 58 into the gap, and communicate with an enclosed manifold passage or trough 38' also formed within the disk 52. In this embodiment, the second liquid coating material is supplied under pressure to the trough 38' through a passage 60 in the disk shaft 58.

When the disk 52 is stationary, and oriented as shown in FIG. 4, with the apertures 36' aligned in a horizontal line perpendicular to the direction of strip advance, performance of the present process proceeds as described above with reference to FIGS. 1-3, and the five apertures produce five parallel longitudinal stripes of the second liquid coating material in a coating layer otherwise constituted of the first liquid coating material delivered to trench 22', it being understood that the second coating material is delivered through the apertures 36' under pressure sufficient to locally displace the first liquid coating material in the wet coating layer. If, however, during continuous advance of the strip 11, and continuous supply of the two liquid coating materials to the apparatus, the disk 52 is rotated about the axis of shaft 56, the apertures 36' (though fixed in position relative to each other) are angularly displaced about that axis, with resultant change in location and spacing of the produced stripes. Thus, for example, rotation of the disk 52 through 45° from the position shown at A in FIG. 8 to the position shown at B in FIG. 8 causes the stripes 44 to change progressively, in location and spacing, from the initial condition shown at 44*a* in FIG. 8 to the final condition shown at 44*b* in FIG. 8, in correspondence with the angular change in position of the apertures relative to the path of strip advance. In this way, diversified pattern effects, with wandering, diverging, and converging stripes can be achieved.

As indicated in FIGS. 6 and 7, each aperture 36' may have an associated short groove 62, tapering in depth and width away from the aperture, and formed in the lower surface 58 of the disk 52 so as to be in contact with the wet coating layer. These grooves, positioned to extend usually or generally, in a downstream direction from their respective associated apertures, serve to impart a fine flecked appearance or texture to the coating in and adjacent the produced stripes.

There is no separate blending disk 48 in the apparatus of FIGS. 4-8, but the movement of the surface 58 of disk 52, in those portions which engage the wet coating layer downstream of the apertures 36', has a like blending effect. In addition, at those portions of the coating layer where one or more stripes are oriented diagonally to the direction of strip advance owing to progressive movement of the disk 52, drag of the fixed portion of wall 26' (downstream of the disk) on the wet coating layer produces some blending along the stripes.

FIGS. 9-13 illustrate a specific embodiment of the invention (currently preferred for production of a coating with a simulated wood grain pattern) of the general type shown in FIGS. 4-8, i.e. having plural coating material delivery apertures carried in a rotatably mounted disk. The apparatus includes a top plate 118 and a bottom plate 120 secured together at their corners by bolts 121*a*, with biasing springs 121*b* provided for maintaining the plates in spaced-apart relation and lateral guides or stops 121*c* projecting upwardly from the lower plate to assure proper register of the plates. Within the top plate 118, there is formed a downwardly opening trench 122 for containing a body of a first liquid coating material supplied under pressure from a suitable source (not shown) through a passage 124. The downwardly facing major surface 126 of the top plate 118 and the upwardly facing major surface 128 of the bottom plate 120 are smooth, planar surfaces and are disposed in spaced parallel planes to define a throat 130 of uniform vertical dimension, through which a strip article (e.g. metal strip) to be coated is advanced longitudinally in the direction indicated by arrows 131.

It will be appreciated that the plates 118 and 120 correspond generally in arrangement and function to the plates 18 and 20, respectively, of the apparatus of FIGS. 1-3 or the plates 18' and 20' of the apparatus of FIGS. 4-8. The downstream wall of trench 122 constitutes the dam 132, in the embodiment of FIGS. 9-13, behind which the first liquid coating material is delivered to the major surface of the strip article to be coated, while the downwardly facing surface 126 of plate 118 constitutes the extended wall past which the coated strip surface advances, corresponding to the wall 26 of FIGS. 1-3. As in the other described embodiments, the downstream or outlet edge 134 of this wall is a sharp discontinuity for assured avoidance of cavitation effects as the coated strip emerges from the throat 130.

A plurality of coating material delivery apertures 136 with associated manifold passages 138 are formed in a disk 152 which is received in a downwardly opening circular recess 154 in the plate 118. This disk has an upwardly projecting vertical shaft 156 and a smooth downwardly facing plane surface 158 that is disposed in coplanar relation to the plate surface 126, downstream of the dam 132, to constitute a portion of the wall facing the coated major surface of a strip article advancing through the throat 130. The apertures 136 open downwardly through the disk surface 158 for delivery, to the coating-filled gap between the wall and the coated strip surface, of a second liquid coating material which is delivered under pressure from a suitable source (not shown) through a passage 160 in the shaft 156 to the manifold passages 138.

Figure 11:
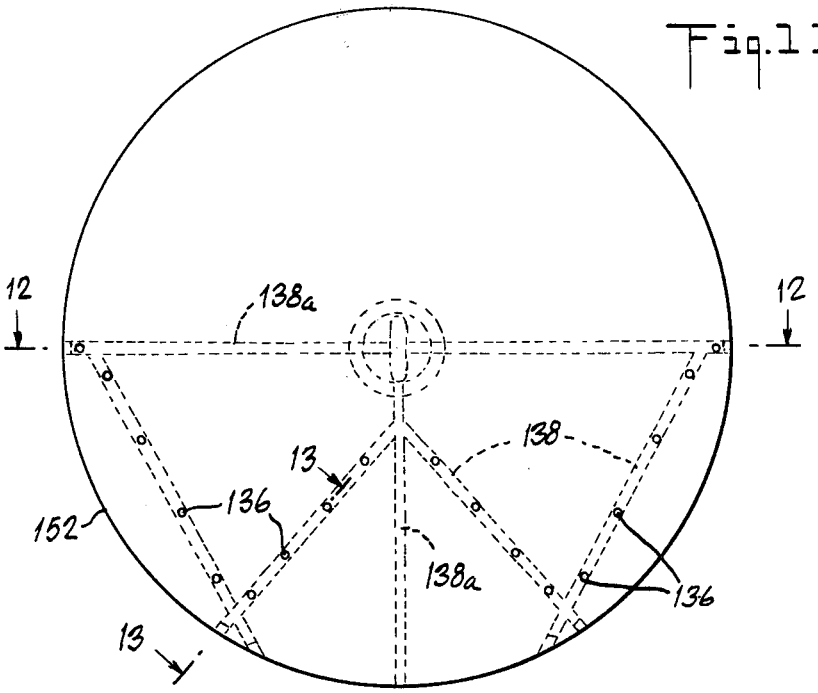
FIG. 11 is an enlarged bottom plan view of the disk of the apparatus of FIG. 9.
Figure 12:
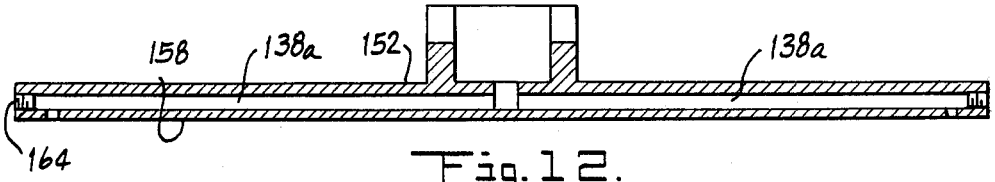
FIG. 12 is a further enlarged sectional view of the disk, taken along the line 12—12 of FIG. 11.
Figure 13:
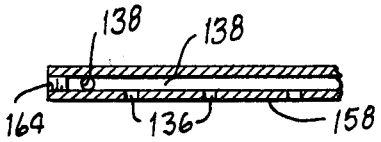
FIG. 13 is a similarly enlarged, fragmentary sectional view of the disk, taken along the line 13—13 of FIG. 11.

The shaft 156 is journaled in a bearing structure 162, mounted atop the plate 118, to support the disk 152 for rotation about an axis perpendicular to the plane of the wall constituted by surfaces 126 and 158. It will be understood that the disk 152, with its apertures 136 and manifold passages 138, corresponds generally in structure and function to the disk 52 of the embodiment of FIGS. 4-8, providing delivery of second liquid coating material to the aforementioned gap under pressure through plural spaced apertures while being rotatable to effect angular displacement of the apertures for varying the positions and spacing of the stripes produced by such delivery of the second coating material. As best seen in FIGS. 11-13, the disk 152 can be a circular metal plate through which the manifold passages 138 are bored; the apertures 136 are drilled into the passages 138 through the lower surface of the plate, and the ends of the passages 138 are then closed by suitable means as indicated at 164.

From FIG. 11, it will be seen that the apertures 136 are distributed across one half of the downwardly facing surface of the disk 152 and are aligned in four rows each comprising four spaced apertures. The rows are arranged at angles to each other in the form of the letter W and are all eccentric with respect to the disk; i.e. a line interconnecting any row of four apertures does not pass through the center of the disk. This arrangement of apertures is found particularly effective for producing a simulated wood-grain pattern of stripes of the second coating material delivered thereto, when the disk is progressively angularly displaced first in one direction and then in the opposite direction during the course of a coating operation; that is to say, with this arrangement of apertures, there are produced a series of narrow stripes individually resembling the lines of a wood-grain pattern and varying progressively in position and spacing, with angular displacement of the disk, in a manner corresponding to that of natural wood-grain lines. The manifold passages associated with the various rows all interconnect with each other and, by further passages 138*a* (also bored through the disk and sealed at their outer ends), are interconnected with the passage 160.

As will be understood, in use of the apparatus of FIGS. 9–13 to coat a strip article with a coating having a simulated wood-grain pattern, the article is continuously advanced along the path indicated by arrows 131 through the throat 130 while a first liquid coating material is delivered under pressure to the trough 122 so as to maintain the trough entirely filled therewith, and while a second liquid coating material is delivered to the manifold passages of the disk 152 under pressure and thence through the apertures 136, with progressive angular displacement of the disk, first in one direction and then in another. The movement of the disk causes the disk surface, in contact with the coating layer, to effect some degree of blending or mixing of the two liquid coating materials downstream of the apertures 136 to enhance further the resemblance to wood-grain lines.

For satisfactory coating operation, it is critical that the disk surface 158 be located very precisely in the plane of the plate surface 126. To facilitate proper mounting of the disk, and this requisite positioning of the surface 158, a series of stops 170 are disposed within the recess 154 and threaded in the plate 118 so as to be vertically adjustable. The stops bear against the upper surface of the disk 152 for establishing the vertical position of the disk relative to surface 126.

Figure 9:
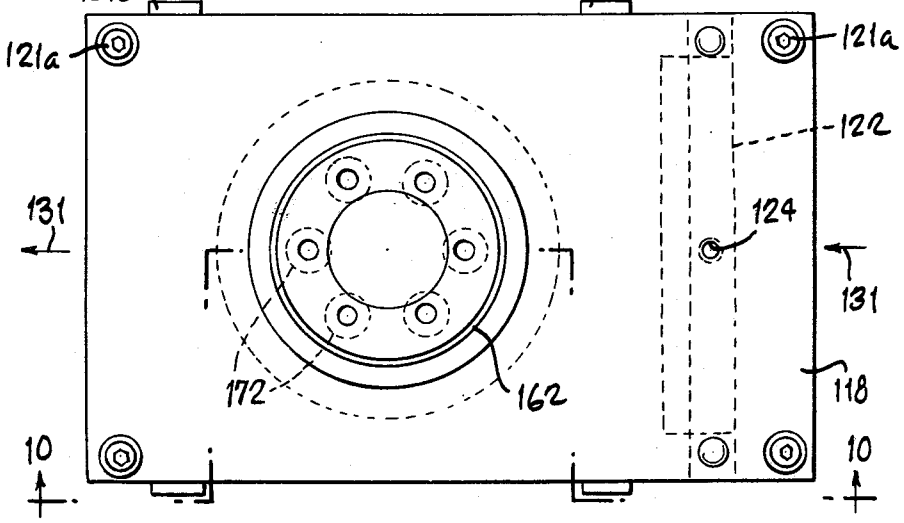
FIG. 9 is a top plan view of a further, and presently preferred, embodiment of the apparatus of the invention.

One particularly convenient arrangement for achieving proper adjustment of the disk position, shown in FIGS. 9 and 10, includes an array of permanent magnets 172 mounted in the plate 118 so as to project into the recess 154 above the disk and to attract the disk (which, in this arrangement, is fabricated of a magnetic metal) upwardly into engagement with the stops 170. Although the magnets 172 do not actually engage the disk, their attraction holds it against the stops, which may then readily be adjusted to assure the requisite coplanarity of the surfaces 158 and 126.

It is to be understood that the invention is not limited to the features and embodiments hereinabove specifically set forth but may be carried out in other ways without departure from its spirit.

We claim:

1. In a process for applying a coating to a major surface of a strip article, including the steps of (a) continuously advancing the article longitudinally past a dam extending transversely of said major surface in adjacent spaced relation thereto while (b) maintaining a body of a first liquid coating material in contact with said major surface immediately ahead of said dam for establishing a continuous wet coating layer on said major surface, and (c) immediately beyond said dam, advancing the article longitudinally past a wall of extended length in the direction of article advance and facing said major surface while restraining the article against movement of said major surface away from said wall beyond a predetermined distance equal to a desired thickness of said wet coating layer, such that said major surface and said wall mutually define a gap entirely filled by said wet coating layer across the width of said layer, the improvement which comprises (d) through at least one aperture in said wall, spaced from said dam in the direction of article advance, delivering at least a second liquid coating material to said gap under pressure sufficient to displace locally the first liquid coating material in the wet coating layer, thereby to establish a stripe of the second liquid coating material in said coating layer.

2. A process according to claim 1, wherein said first and second coating materials are pigmented, and differ from each other in pigmentation, such that said stripe is visibly distinguishable from portions of said coating layer constituted of said first coating material.

3. A process according to claim 1, including the step of selectively moving a portion of said wall, beyond said one aperture, in a direction parallel to said major surface and transverse to the direction of article advance, during advance of the article and delivery of said second coating material through said one aperture, for effecting blending of said first and second coating materials in and adjacent said stripe.

4. A process according to claim 3, wherein said wall is planar and has a movable portion comprising a disk rotatable about an axis perpendicular to the plane of the wall, and wherein the moving step comprises effecting angular movement of said disk about said axis.

5. A process according to claim 1, including the step of moving said one aperture in a direction parallel to said major surface and transverse to the direction of article advance, during advance of the article and delivery of the second coating material through said one aperture, for progressively changing the location of said stripe, along the length of said article, relative to the sides of said article.

6. A process according to claim 5, wherein said wall is planar and has a movable portion comprising a disk rotatable about an axis perpendicular to the plane of the wall, said one aperture being located in said disk, and wherein the moving step comprises effecting angular movement of said disk about said axis.

7. A process according to claim 1, wherein said second liquid coating material is delivered to said gap under pressure as aforesaid through a plurality of apertures spaced apart in said wall transversely of the direction of strip advance, thereby to establish a corresponding plurality of stripes of the second liquid coating material in said coating layer.

8. A process according to claim 7, including the step of progressively moving said apertures, parallel to said major surface and transversely of the direction of article advance, during advance of the article and delivery of the second coating material as aforesaid, for progressively varying the locations of the stripes, along the length of the article, relative to the sides of the article.

9. A process according to claim 8, wherein the aperture-moving step comprises moving the apertures for progressively varying the spacing between the stripes.

10. A process according to claim 9, wherein the aperture-moving step comprises displacing the apertures angularly above an axis perpendicular to said major surface.

11. A process according to claim 10, wherein said wall is planar and has a movable portion comprising a disk rotatable about said axis, said apertures being located in said disk, and the aperture-moving step comprises angularly displacing said disk about said axis.

12. A process according to claim 11, wherein said apertures are aligned in a plurality of rows eccentric to said axis, with at least one of said rows oriented at an acute angle with respect to at least one other of said rows.

13. A process for producing a longitudinally striped coating on a strip article, comprising (a) establishing, on a major surface of said article, a wet coating layer of a first liquid coating material, and, while (b) advancing the article longitudinally past a wall of extended length in the direction of strip advance with the coating layer in liquid condition, said wall being in proximate facing relation to said major surface and substantially uniformly spaced therefrom at such distance that said coating layer is in contact with said wall, (c) delivering through said wall into said coating layer, at plural localities spaced across the width thereof, a second liquid coating material under pressure sufficient to effect local displacement of said first liquid coating material and thereby to establish plural spaced longitudinal stripes of said second liquid coating material in said coating layer, and (d) angularly displacing said localities about an axis perpendicular to said major surface, as said article is advanced and said second coating material is delivered, for varying the location and spacing of said stripes along the length of the strip.

* * * * *

UNITED STATES PATENT AND TRADEMARK OFFICE

CERTIFICATE OF CORRECTION

PATENT NO. : 4,356,216

DATED : October 26, 1982

INVENTOR(S) : J. LYNN GAILEY et al.

It is certified that error appears in the above-identified patent and that said Letters Patent is hereby corrected as shown below:

Col. 4, line 24, "tranch" should read --trench-- .

Col. 5, line 35, "at least" should read --at present-- .

Col. 10, line 55, "above" should read --about-- .

Signed and Sealed this

*Twelfth* Day of *March 1985*

[SEAL]

*Attest:*

DONALD J. QUIGG

*Attesting Officer* *Acting Commissioner of Patents and Trademarks*